United States Patent [19]

Carroll

[11] Patent Number: 4,623,175

[45] Date of Patent: Nov. 18, 1986

[54] HIGH SECURITY DOOR LATCH AND DEADBOLT

[76] Inventor: Charles Carroll, 1301 20th St. NW. #503, Washington, D.C. 20036

[21] Appl. No.: 550,745

[22] Filed: Nov. 10, 1983

[51] Int. Cl.[4] ..... E05C 1/16

[52] U.S. Cl. ..... 292/40; 70/143

[58] Field of Search ..... 292/167, DIG. 44, 40, 292/169, 337; 70/143

[56] References Cited

U.S. PATENT DOCUMENTS

| | | | |
|---|---|---|---|
| 188,308 | 3/1877 | Sherman | 70/143 |
| 663,503 | 12/1900 | Laureyns | 70/143 X |
| 1,199,645 | 9/1916 | Wicks | 70/143 |
| 2,370,690 | 3/1945 | Schlage | 70/143 |
| 3,159,994 | 12/1964 | Schulz | 292/207 X |
| 3,322,451 | 5/1967 | Bredemus | 292/137 |
| 3,471,188 | 10/1969 | Hawkins | 292/264 X |
| 3,912,309 | 10/1975 | Fischer et al. | 70/143 X |
| 4,037,865 | 7/1977 | Hook | 292/357 |
| 4,422,677 | 12/1983 | Gater | 292/167 X |

*Primary Examiner*—Richard E. Moore

*Attorney, Agent, or Firm*—Poms, Smith, Lande & Rose

[57] ABSTRACT

A combined door latch and deadbolt is arranged to fit within the normal latch bolt openings provided in a pre-cut door. The solid combined longlatch and deadbolt is arranged to protrude at least one inch out from the door and into a striker plate which has a long angled depressor element against which the longlatch bears when the door is being swung closed. The longlatch is mounted in a cylinder which extends not only through the normal hole from the edge of the door, but also most of the way through the larger transverse hole provided in a pre-cut door, which is aligned with the usual position of the door handle. This relatively long cylinder provides the desired additional guidance for the longlatch with its increased travel as compared with conventional door latches. Aligned with the handle and the keyhole and tumbler mechanism is a rotatable member having a lever arm, and a latch pulling member is pivotally mounted to the lever arm to withdraw the latch from the striker plate when the handle or the key is operated. The longlatch pulling member is free to move in a direction perpendicular to the axis of movement of the longlatch in addition to axial movement so that it may follow the extended throw of the lever arm required for the one inch retraction of the longlatch and compress the biasing springs with full mechanical efficiency. A deadlocking plunger member is also provided, and special camming arrangements serve to operate a deadlocking catch to prevent forced movement of the longlatch when the deadlocking plunger is in engagement with the face of the striker plate.

13 Claims, 8 Drawing Figures

HIGH SECURITY DOOR LATCH AND DEADBOLT

FIELD OF THE INVENTION

This invention relates to a combined door latch and deadbolt.

BACKGROUND OF THE INVENTION

A normal door latch only extends about ½ inch from the front edge of the door. When consideration is given to the normal space between the door frame and the outer edge of the door, there may only be about ⅜ inch of the latch which may penetrate the opening in the striker plate. With this minimal engagement, a good strong kick in the center of the door may bow the door so that the latch is released; or a simple prying tool may be employed to release the door, and permit undesired entry. In order to avoid this problem, many people now use a supplemental deadbolt which is normally key-operated, and which extends into the door frame a full inch. This precludes opening of the door by the simpler expedients mentioned hereinabove. It is also noted in passing that some insurance companies will give reduced rates to home owners who equip their homes with deadbolts on the exterior doors, and certain other safety equipment.

One prior proposed arrangement for a combination latch and deadbolt lock is disclosed in U.S. Pat. No. 4,255,953, granted Mar. 17, 1981. This prior patent includes two modes of operation. In one mode of operation the latch only extends for the usual ½ inch, and the door operates in all respects like a normal door. Then, through the special use of a key or other actuation arrangements, the conventional type of latch is extended by an additional half an inch so that it acts in the manner of a deadbolt. It is noted, however, that although the latch and deadbolt functions are accomplished by this single device, the deadlock can be actuated from the outside of a door in which it is installed only by inserting and turning a key.

The simple action of inserting and turning a key, as important as it is in providing the greatly increased security of a deadbolt lock when compared to a conventional latch, is one which many people are unwilling to do regularly. Perhaps the best illustration of this fact is that the great majority of hotel and motel rooms can be locked from the outside only by closing the door. Deadbolt locks are generally provided, but they can be locked only from the inside. Thus, in spite of the small extra cost of installing deadbolt locks which can be locked from both sides of the door in order to provide much greater security, to the benefit of both management and guests of hotels and motels, this cost is evidently considered excessive in view of the evident low probability that the outside deadlocking arrangements would be used. Similarly, this reluctance to use a key to lock a door from the outside applies as well to people locking the door of their homes.

Accordingly, a principal object of the present invention is to provide an improved combination latch and deadbolt in a single inexpensive unit which will fit and conventionally cut doors, and which can be locked from the outside by merely pulling the door closed, thus providing the convenience of a conventional latch as well as the security of a deadbolt.

SUMMARY OF THE INVENTION

In accordance with the present invention, a combination door latch and deadbolt includes a longlatch which extends at least one inch from the front edge of the door, and also includes a striker plate having an opening to receive the longlatch, and which also includes an angled depressor portion for engaging the beveled outer edge of the extended longlatch and for moving it to the retracted position as the door is being closed. This means that the depressor portion of the striker plate must extend away from the recess to be engaged by the longlatch sufficiently far, depending upon its angle, to engage the beveled outer edge of the extended longlatch, so that as the door is swung closed, the latch will be pushed back into the door.

In accordance with another feature of the invention, the fixed guide or housing for the longlatch extends not only through the normal smaller opening of a pre-cut door which extends from the edge of the door, but also more than half way through the larger transverse cylindrical hole which is provided in pre-cut wooden doors. This elongated guide provides the desired full support for the longlatch to give it adequate strength desirable in secure deadbolts. It also provides the space for the springs and other parts which permit the longlatch to move back and forth by one full inch.

Additional features of the invention include the provision of a longlatch retracting member which is engageable by the lever arm operated by the door knob or key, which is movable both in the axial direction aligned with the longlatch and also transverse thereto, to facilitate the mechanically efficient application of retracting force to the longlatch against the normal spring biasing force, over the necessary long throw provided by the one inch extension of the longlatch during normal latching operations. In addition, a deadlocking plunger is provided to control the operation of a deadlocking catch which holds the longlatch against local mechanical retraction, when the deadlocking plunger engages the face of the striker plate. Camming surfaces are provided to shift the position of the deadlocking catch and to release the longlatch and permit its movement to the retracted position when the deadlocking plunger is in its extended position, or when the door knob or key is actuated. As a further feature, both edges of the longlatch may be slightly beveled and detent arrangments provided so that the latch may be held in a position where it only extends about an eighth of an inch from the door, thus permitting entrance and exit without locking oneself out. The deadlocking plunger in this case is inactive so that the longlatch is easily pushed into its retracted position as the door is pushed from the outside, when one of the beveled edges engages the lip of the recess in the striker plate. Also, the fixed elongated guide or housing for the longlatch is preferably cylindrical, with long biasing springs for the longlatch extending well beyond the axis of the door handle, which may pass through the cylindrical guide, along with transverse bolts for holding the door handle and key tumbler assemblies together.

One advantage of the present invention is the increased security afforded by the structure in which the latch is normally in full deadlocking operation, and the fact that the user is readily alerted to the mode of operation of the latch by simply noticing whether the latch is extended in its normal one inch distance, or is substantially fully retracted when set to the unlocked state.

Attempting to turn the knob when opening the door also alerts the user to the mode of operation, since the knob turns only in the locked state. Thus, the danger of locking oneself out inadvertently is virtually eliminated. In addition, of course, a major advantage of the present invention is that deadlocking action is automatically obtained when closing the door, without the need for key or special deadbolt actuation.

Other objects, features and advantages of the invention will become apparent from a consideration of the following detailed description and from the accompanying drawings.

DETAILED DESCRIPTION

Figure 1:
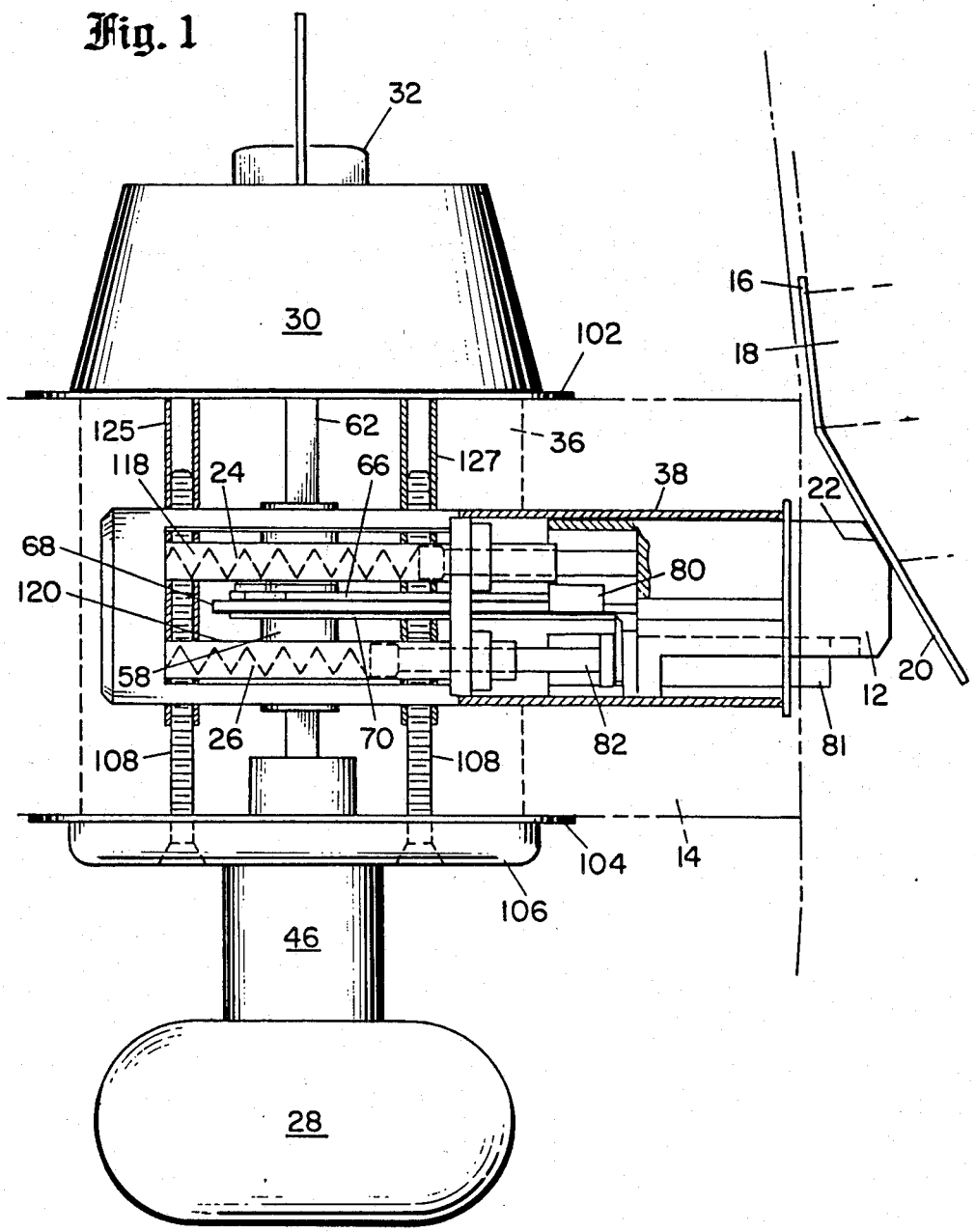
FIG. 1 is a cross-sectional view showing a combined door latch and deadbolt illustrating the principles of the invention.

Referring more particularly to the drawings, FIG. 1 is a cross-sectional view showing a latch and a deadbolt 12, mounted in a door 14 for engagement with a striker plate 16 having a recess 18 for receiving the long latch member 12, and a depressor portion 20 for engaging the bevel 22 on one corner of the longlatch 12 and for causing the movement of the latch 12 inwardly of the door 14, against the spring pressure of the two coil springs 25 and 26. As shown in FIG. 1, the door 14 may be provided with a conventional rotating knob 28 inside the house or other structure, and a key assembly 30 together with a separate handle 32 mounted on the outside of the door.

Figure 2:
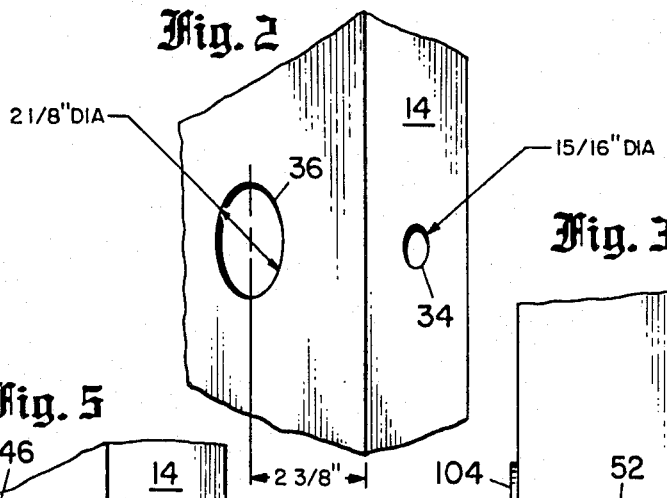
FIG. 2 shows a conventional pre-cut wooden door with the location and sizes of the holes normally included in such a door shown in this view.

Incidentally, the standard opening for latches or locks in a door includes a 15/16 inch diameter hole 34 extending inwardly from the edge of the door 14, all as shown in FIG. 2, and a larger $2\frac{1}{8}$ inches diameter hole 36 centered at the same elevation as the smaller hole but extending transversely through the door, with the larger hole being centered at a distance of $2\frac{3}{8}$ inches from the front edge of the door. It is important that a lock assembly be configured to fit into these standard pre-cut door openings.

Now, referring back to FIG. 1 of the drawings, it may be noted that the longlatch 12 is mounted within a cylindrical housing 38 which extends from the front edge of the door 14 through the length of the smaller hole 34, and most of the way across the larger hole 36. This gives good support to the longlatch 12 and provides good security and impact resistance to the entire assembly, if an effort is made to force the door 14 while the longlatch 12 is in position in the recess 18.

Figure 3:
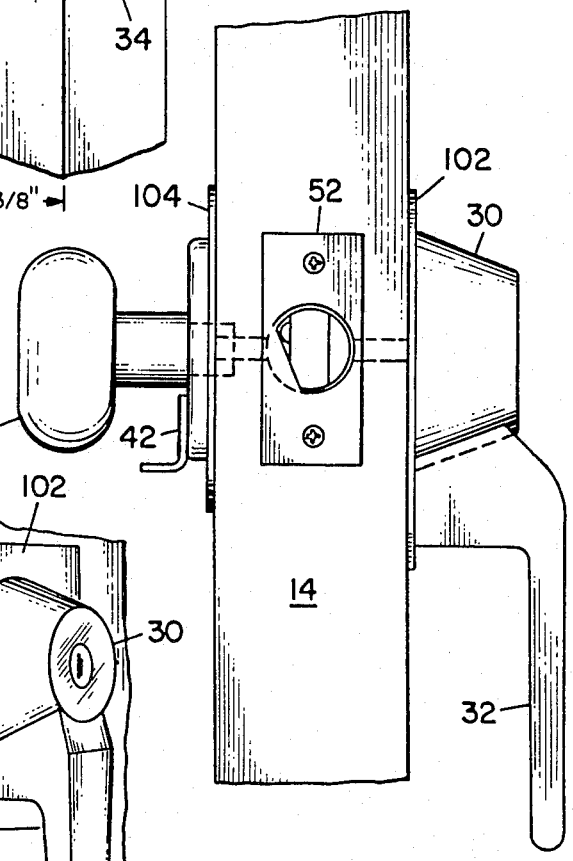
FIG. 3 is a view of a door equipped with a combined latch and deadbolt illustrating the principles of the invention.
Figure 5:
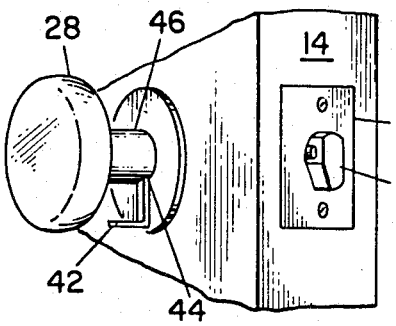
FIG. 5 is a showing of a unit illustrating the principles of the invention from the inside of a home, with the knob mounted on the inside of the door and a detent pressed upward to hold the latch in the partially retracted position.
Figure 4:
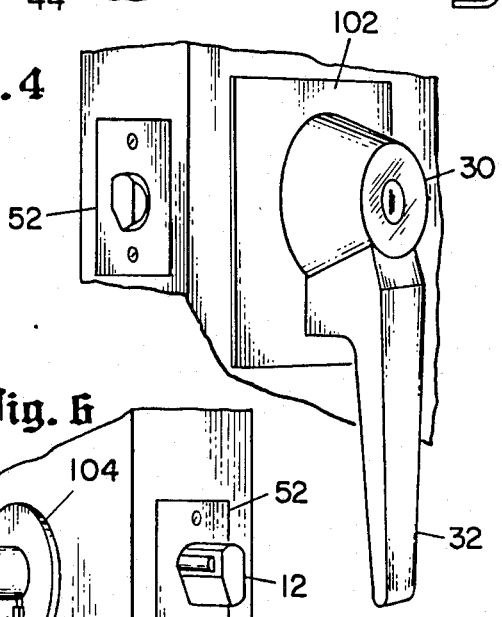
FIG. 4 is a showing of the door of FIG. 3 from the outside thereof.
Figure 6:
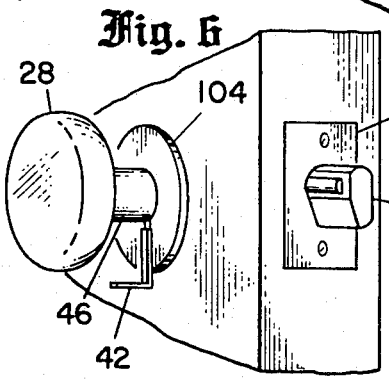
FIG. 6 is a showing from the inside of a home with the detent inactive and with the longlatch member being fully extended; and FIGS. *7a*, *7b*, and *7c* together show an exploded view of a combined latch and deadbolt assembly.

Now, considering the figures which appear on sheet 2 of the drawings, these include FIGS. 2 through 6. FIG. 2, as previously mentioned, shows the location of the drilled holes included in a pre-cut wooden door. FIG. 3 is a view of the structure shown in FIG. 1 as viewed from the edge of the door 14. FIG. 4 is a similar view to that of FIG. 3 but taken from a slight angle outside of the door, from the side of the door with the keyhole assembly 30 and the handle 32. FIGS. 5 and 6 show a door installation with the detent 42 in two different positions in the two figures. The detent 42 may be located either at the top or above the knob 28 or below the knob 28 as shown in the drawings. Although either arrangement may be employed, the location of the detent below the knob 28 is slightly to be preferred as the detent may be operated with the forefinger in the manner of a trigger, with this arrangement.

The detent 42 may be omitted, as for hotel room locks, along with the slot 43 (in the face plate 106) and the recess 44, so that the door 14 is locked whenever it is closed.

Returning to FIGS. 5 and 6, in FIG. 5, the detent 42 is pressed up to engage the recess 44 in the cylindrical member 46 forming part of the knob assembly. With the detent in recess 44, the rotation of the knob assembly is limited, and the longlatch 12 only extends a very short distance from the front edge of the door 14. However, as shown in FIG. 6, with the detent 42 being released, and no longer in engagement with the recess in the cylindrical member 46 forming part of the door knob, the latch 12 is free to extend for the full inch or more of travel, under the outward pressure from the coil springs 24 and 26, so that full deadlocking action obtains, whenever the door is closed.

FIGS. *7a* and *7b* together form an exploded view of the latch, deadbolt and deadlocking assembly shown in cross-section in FIG. 1. The major components shown in FIG. *7a* and *7b* which have not been specifically referenced above, include the latch faceplate, made up of two plates 52 and 54, with the front plate 52 being exposed at the edge of the door as shown in FIG. 3, for example, and the plate 54 being mounted on the other side of the flange 56 at the front edge of the elongated cylinder 38, thereby holding the cylinder 38 firmly in place in door 14. Incidentally, the elongated cylinder 38 appears at the right hand side of FIG. *7a*, while the plates 52 and 54 appear at the upper right in FIG. *7b*.

Figure 7A:
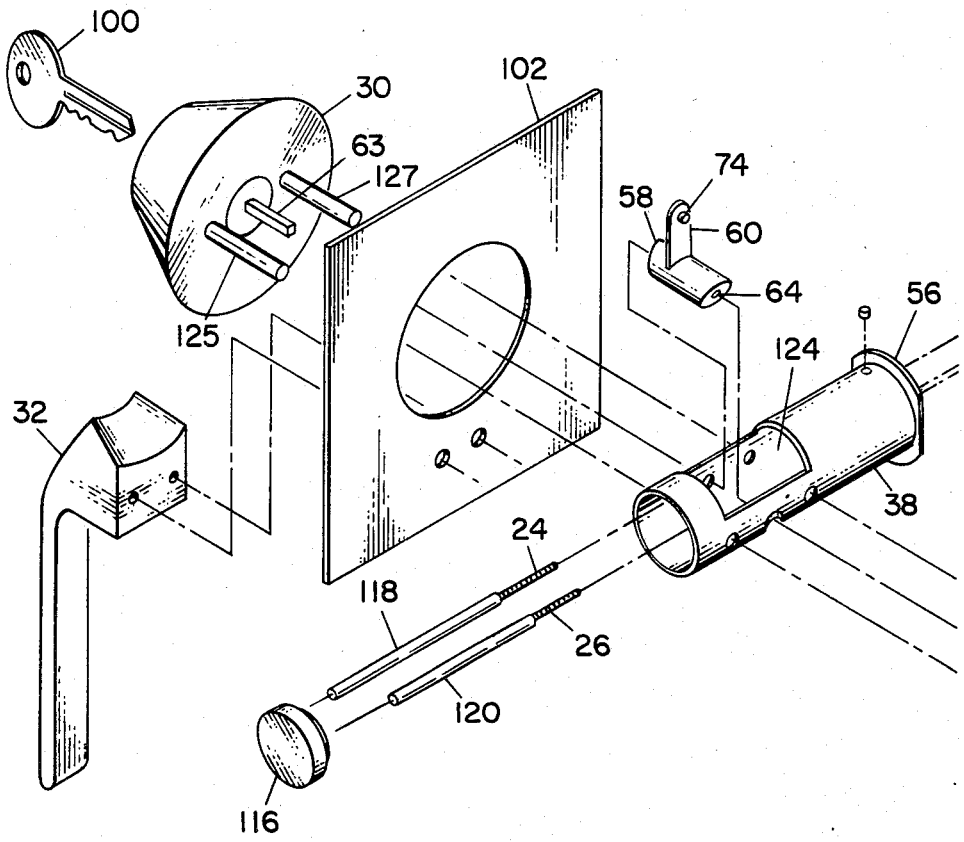
Figure 7B:
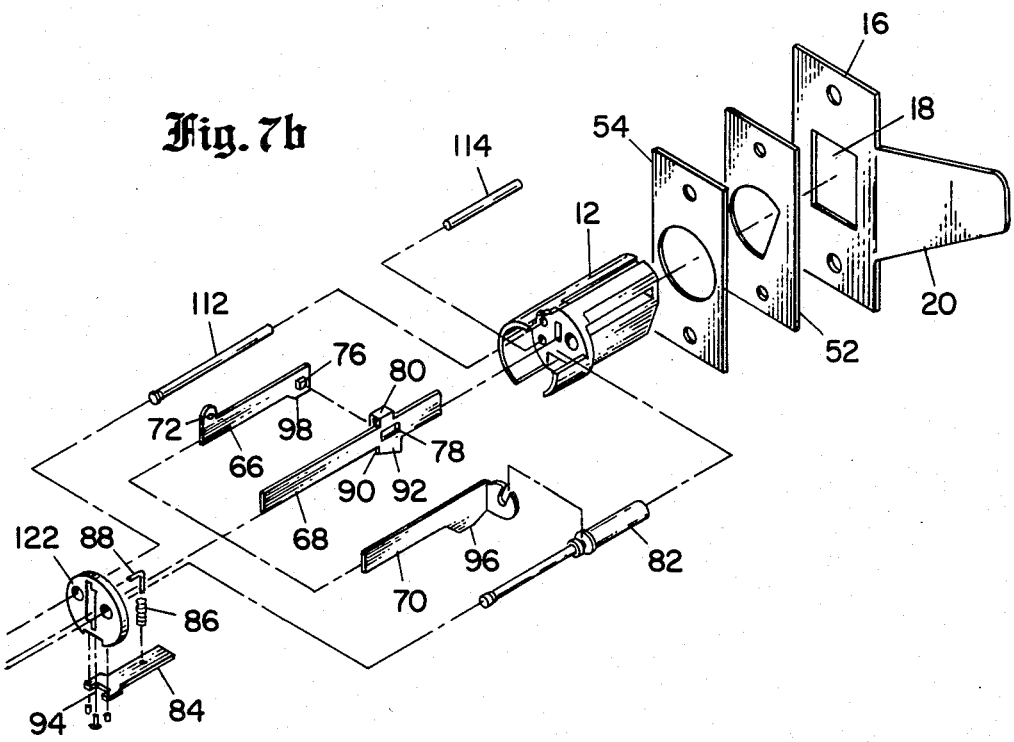
Figure 7C:
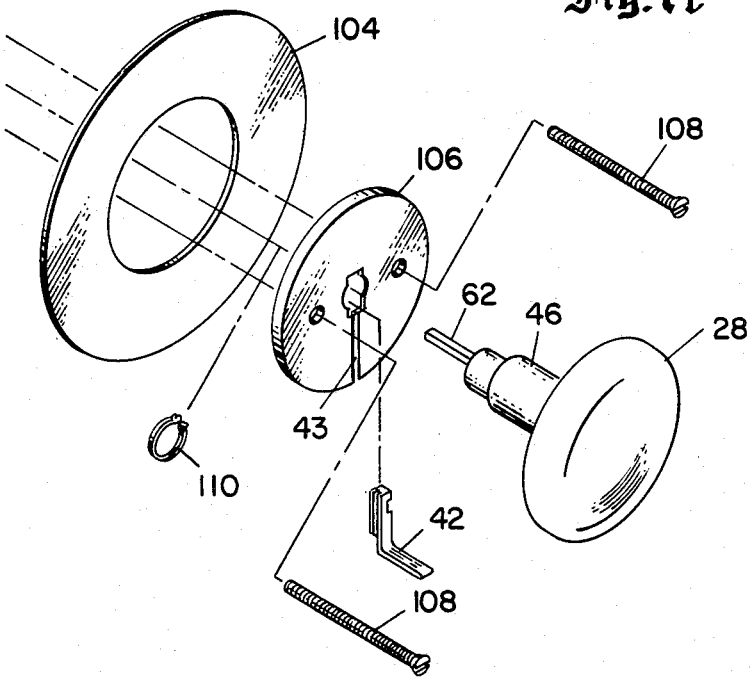

A cam member 58 provided with a lever arm 60 is mounted on the shafts 62 and 63 for rotation as the knob 28 or the key 100 is rotated. The shafts 62 and 63 may be square, or of a round configuration with a flat on one side for engaging with a mating hole 64 extending through the body of the cam member 58. There are three flat members 66, 68, and 70 which are mounted close to one another as shown in FIG. 1, and also in FIG. *7b*. The upper one of these flat strips, the latch pulling strip 66, is provided with a recess or hole 72 which is engaged by the pin 74 on the lever arm 60 secured to the cam member 58. The central flat shaft or plate 68 is rigidly secured to the longlatch 12. A driving pin 76 on the latch pulling strip 66 extends through the slot 78 in the central shaft 68, with the bent arm 80 extending over the latch pulling strip 66 to preclude disengagement of the pn 76 from the slot 78. When the knob 28 or the key 100 is turned, and the camming member 58 is rotated, the lever arm 60 is moved counterclockwise as shown in FIG. 7*a* and the latch pulling strip 66 is moved to the left as shown in FIG. 7*b*, the pin 76 engages the rear of the slot 78, and the central shaft 68 together with the longlatch 12 are retracted and moved to the left as shown in FIG. 7*b*, against the force of the coil spring 24, and also the force of the spring 26.

The operation of the deadlocking plunger 82 and the deadlocking catch 84 will now be described. In general, the purpose of a deadlocking plunger is to prevent movement of the latch by direct engagement of a latch with a tool or a credit card, for example, when the door is closed, and the latch is properly located in the opening in the striker plate. In operation, the deadlocking plunger, such as plunger 82, rests on the outer surface of the striker plate and does not penetrate the striker plate, and this operation, which is of course different from the operation of the deadlocking plunger 82 which moves with the longlatch 12 when the door is open, is employed to implement the deadlocking function.

The small coil spring 86 guided by the pin 88, is mounted below the deadlocking catch 84 to mechanically bias the front end of the deadlocking catch upwardly so that it is behind the detent formed by the rear edge 90 on the downwardly extending lug 92 of the central shaft 68. Incidentally, the deadlocking catch 84 is pivoted at its rear end 94, at the bottom of disk 122. Now, when the deadlocking plunger is in its forward position, fully extended, when the door is open, the lower surface 96 on the deadlocking catch disabling strip 70 engages the front end of the deadlocking catch 84 and pushes it down so that it cannot engage the detent 90. Then, as the door is swung closed, the depressor plate 20 may freely force the latch 12 into its retacted position against the force of the coil springs 24 and 26. It may also be noted that the latch 12 is provided with a slot at its lower rear end to receive the (inactive) deadlocking catch 84 as the door is closed and the longlatch 12 moves into cylinder 38.

Now, assuming that the door is closed and that the latch is in its locked position in the recess 18, the deadlocking plunger 82 will be resting on the face of the striker plate 16, and the deadlocking catch disabling strip 70 will be pushed to the rear, so that it does not interfere with the upward movement of the deadlocking catch 84. Under these conditions, the front edge of the deadlocking catch 84 will lie behind the detent 90, so that a mechanical force by a tool or a credit card on the latch 12 would not cause its movement toward the retracted or opening condition. However, when the door knob 28 or the key 100 is turned, as mentioned above, the latch pulling strip 66 is moved to the left, and, prior to the engagement of the pin 76 with the rear of the slot 78 on the central shaft 68, the lower camming surface 98 on the latch pulling strip 36 will engage the deadlocking catch 84 and push it down, away from possible engagement with the detent 90. Thus, as the pin 76 reaches the rear of the slot 78, the deadlocking catch 84 has disabled, and the central shaft and its associated longlatch are free to be moved to the retracted position.

For completeness, certain other parts which appear in FIGS. 7*a* and 7*b* will be noted. At the far upper left in FIG. 7*a*, a key 100 is shown. On either side of the door are face plates 102 and 104 which may, or course, be either rectangular, as 102 is shown, or circular, as 104 is shown. Plate 106 adjacent the inner face plate 104, serves to mount the detent 42, and the bolts 108 pass through openings in the plate 106 and engage the threaded sleeves 125 and 127 extending from the key tumbler assembly 30. A circular retaining spring member of C-clip 110 engages a recess on the cylindrical member 46 and holds it in its proper inward position. The two shafts 112 and 114 are made of hardened steel and provide additional security against possible hacksaw attacks, for the assembly. The shaft 114 is a "roll pin", i.e.; it is free to roll with the movement of a saw, thus providing security against even the hardest saw. The springs 24 and 26 bear on the ends of the shafts 112 and 82, respectively. The circular end member 116 closes the left-hand inner end of the cylinder 38, and provides mounting and support for the small cylindrical tubes 118 and 120 which contain the long coil springs 24 and 26. Incidentally, the coil springs 24 and 26 are preferably about twice as long as the normal coil springs which are employed in conventional latches in view of the additional throw of the longlatch 12. It is also noted again, that because of the extended throw of the longlatch 12, the cylinder 38 should be substantially longer than that employed in conventional doors, to provide adequate strength and security, as well as operating space, for the longlatch 12 and other parts. Normally, the cylinder does not extend significantly into the transverse opening 36 (see FIG. 2). In the present case the disclosed design represents a unique and ingenious solution to the need to fit all of the desired components into a conventionally pre-cut door, while concurrently providing the desired additional spring length and cylindrical latch support to accommodate the extended one inch throw of the longlatch 12.

Incidentally, the circular support member 122 (see FIG. 7*b*) is mounted within the tube 38 immediately to the right of the recess 124 as shown in FIG. 7*a*. This member 122 has openings to support the front ends of tubes 118 and 120, permitting the passage of the shafts 112 and 82 into engagement with springs 24 and 26, and also supports the rear end of the deadlocking catch 84. The central opening in the support member 122 permits the movement of the three elongated plates 66, 68, and 70.

It may also be noted that the latch pulling member 66, in following the lever 60, moves not only axially with respect to the longlatch and the cylinder 38, but also has some transverse movement, required by the extended movement of the pin 74 on lever arm 60 through a circular path. This is in contrast with somewhat similar mechanisms used in deadlocking devices where the latch pulling member is secured to the latch, moves rectilinearly and therefore has reduced mechanical efficiency.

Certain aspects of the configuration of the deadlocking plunger and its relationship to the longlatch and the striker plate opening are also deserving of note. Specifically, a normal deadlocking plunger extends to the end of the latch. Accordingly, if the latch does not fully penetrate the opening in the striker plate, the deadlocking plunger may also go into the opening in the striker plate, and would therefore not operate in its intended manner. In the case of the present design, as shown in FIG. 1, however, the normal maximum extent of the deadlocking plunger 82 is only to a point back of the start of the bevel 22 on the front of the longlatch 12. Accordingly, once the longlatch 12 penetrates opening 18 (which makes a close fit with the main part of the longlatch 12), the deadlocking plunger cannot penetrate the opening in the striker plate; and the possibility of malfunction is thereby avoided.

In conclusion, it is to be understood that the foregoing detailed description and accompanying drawings relate to one illustrative embodiment of the invention. Other arrangements may be employed to implement various features of the invention without departing from the spirit and scope of the present invention. Thus, by way of example, and not of limitation, the precise mechanical arrangements for implementing the deadlocking, and biasing, as well as other mechanical functions and movements may be accomplished by alternative arrangements. Accordingly, the present invention is not limited to that precisely as shown and described hereinabove.

What is claimed is:

1. A combined deadbolt and longlatch assembly for providing deadbolt security for normal use with standard pre-cut external doors having a transverse opening substantially $2\frac{1}{8}$ inches in diameter located substantially $2\frac{3}{8}$ inches from the edge of the door, comprising:

a longlatch;

a striker plate having a flat portion with an opening to receive said longlatch, and an extended depressor means oriented at a substantial angle with respect to said flat portion for moving said longlatch to its retracted position as the door is closed;

means including a cylinder closely enclosing and guiding said longlatch for mounting said longlatch in a standard pre-cut door, for movement of one inch or more from the outer edge of the door toward said strikers plate which is to be mounted on a door frame;

said cylinder having a length greater than $2\frac{3}{8}$ inches and slightly less than $3\frac{7}{16}$ inches to extend substantially from the edge of the door not only through the smaller standard hole in pre-cut doors which extends from the edge of the door, but also through substantially more than half of the larger transverse opening in pre-cut doors to provide the desired support and operating space for the extended travel of the longlatch and associated operating mechanism;

spring means mounted within said operating space and extending toward said longlatch from a point substantially beyond the center of the said larger transverse opening and away from the edge of the door, for normally biasing said longlatch to the fully extended position;

said depressor means on said striker plate extending to a distance in the order of one inch away from the plane of said flat portion thereof;

means including a knob for mounting on at least one side of the door for substantial alignment with the center of the transverse opening for retracting said longlatch the full one inch extension thereof from said striker plate;

means including (1) a deadlocking plunger mounted adjacent to said longlatch for movement substantially parallel to said longlatch and (2) mechanical linkage means between said deadlocking plunger and said longlatch, to detent the longlatch when the longlatch is in its extended position and the deadlocking plunger is in its retracted position, and to release said longlatch when said deadlocking plunger is in its extended position;

said longlatch being provided with a bevel on at least one side thereof to engage said striker plate; and means within said assembly for preventing forward travel of said deadlocking plunger beyond the point along said longlatch where said bevel starts.

2. A combined deadbolt and longlatch assembly as defined in claim 1 wherein said retracting means includes a rotating lever arm and an elongated retracting member extending from said lever arm to said longlatch, said retracting member being free to move in a direction transverse to the axis of the longlatch to follow the lever arm, as well as parallel to the axis of the longlatch, whereby the movement of the longlatch of at least one inch may be accommodated and the springs compressed with mechanical efficiency.

3. A combined deadbolt and longlatch assembly as defined in claim 1 wherein said longlatch has a substantial bevel on one side of said longlatch intended to engage the striker plate, and a very slight bevel on the other side thereof.

4. A combined deadbolt and longlatch assembly as defined in claim 3 wherein manually operable detent means are provided for selectively preventing forward travel of said longlatch beyond the point where said slight bevel engages outer lip of the recess in said striker plate when the door is pushed open from the closed position, while permitting the bolt to retract, upon engagement with the striker plate.

5. A combined deadbolt and longlatch assembly as defined in claim 4 wherein said detent includes actuation means located below the door knob for operation with the forefinger in the manner of a trigger.

6. A combined deadbolt and longlatch assembly as defined in claim 1 wherein said cylinder is of sufficient length to extend substantially across the entire diameter of the larger transverse opening in a pre-cut door having a transverse opening at least $2\frac{1}{8}$ inch in diameter located at least $2\frac{3}{8}$ inches from the edge of the door.

7. A combined deadbolt and longlatch assembly as defined in claim 1 wherein said cylinder is at least two and one-half inches in length.

8. A combined deadbolt and longlatch assembly as defined in claim 1 further including a door knob faceplate means for mounting on the inside of the door, and fastener means extending through said cylinder for securing said door knob faceplate means and said keyhole operating assembly together.

9. A combined deadbolt and longlatch asesmbly as defined in claim 1 wherein said cylinder is partially cut away near the center of said large transverse hole to provide clearance for a portion of said longlatch retracting means.

10. A combined deadbolt and longlatch assembly as defined in claim 1 wherein said retracting means is mounted in said cylinder, and includes two shafts, one extending from said knob and the other form said keyhole operating assembly halfway through said cylinder.

11. A combined deadbolt and longlatch assembly for providing deadbolt security, comprising:

a longlatch;

a striker plate having a flat portion with an opening to receive said longlatch, and an extended depressor means oriented at a substantial angle with respect to said flat portion for moving said longlatch to its retracted position as a door in which the longlatch may be mounted is closed;

support assembly means for mounting said longlatch in a door for movement of one inch or more from the outer edge of the door toward said striker plate to be mounted on the door frame;

spring means for normally biasing said longlatch to the fully extended position;

said depressor means on said striker plate extending to a distance in the order of one inch from the plane of said flat portion thereof;

manually operative means for retracting said longlatch from said striker plate;

means including (1) a deadlocking plunger mounted adjacent to said longlatch for movement substantially parallel to said longlatch and (2) mechanical linkage means between said deadlocking plunger and said longlatch, to detent the longlatch when the longlatch is in its extended position and the deadlocking plunger is in its retracted position, and to release said longlatch when said deadlocking plunger is in its extended position;

the width of the opening in said striker plate being slightly more than the width of said longlatch, but less than the combined width of said longlatch and the portion of said deadlocking plunger which strikes said striker plate;

said longlatch being provided with a bevel on at least one side thereof to engage said striker plate; and means within said assembly for preventing forward travel of said deadlocking plunger beyond the point along said longlatch where said bevel starts.

12. A combined deadbolt and longlatch assembly as defined in claim 11 wherein the width of the opening in said striker plate is slightly more than the width of said longlatch, but less than the combined width to said longlatch and the portion of said deadlocking plunger which strikes said striker plate.

13. An assembly as defined in claim 11 wherein said spring means includes two springs, and further including a pair of tubes for mounting and guiding said two tubes, and a central disk-shaped guide piece mounted in said cylinder for guiding the longlatch retracting member and for mounting said pair of tubes.

* * * * *